US005194895A

United States Patent [19]

Bares

[11] Patent Number: 5,194,895

[45] Date of Patent: Mar. 16, 1993

[54] PRINTING MACHINE ADAPTIVE SETUP

[75] Inventor: Jan Bares, Webster, N.Y.

[73] Assignee: Xerox Corporation, Stamford, Conn.

[21] Appl. No.: 760,035

[22] Filed: Sep. 13, 1991

[51] Int. Cl.[5] ..... G03G 21/00

[52] U.S. Cl. ..... 355/208; 355/204; 355/313

[58] Field of Search ..... 355/200, 201, 202, 204, 355/313, 208; 377/15, 16

[56] References Cited

U.S. PATENT DOCUMENTS

| | | | |
|---|---|---|---|
| 3,893,175 | 7/1975 | Solomon | 377/16 X |
| 3,997,873 | 12/1976 | Thornton | 355/201 X |
| 4,615,609 | 10/1986 | Hanma | 355/200 |
| 4,677,310 | 6/1987 | Midorikawa et al. | 355/202 X |
| 4,701,044 | 10/1987 | Horiuchi et al. | 355/218 |
| 4,882,604 | 11/1989 | Kato et al. | 355/201 |

FOREIGN PATENT DOCUMENTS

| | | | |
|---|---|---|---|
| 0168262 | 10/1982 | Japan . | |
| 0145480 | 7/1986 | Japan | 355/202 |
| 0184578 | 8/1986 | Japan . | |
| 0180565 | 7/1989 | Japan . | |
| 0261665 | 10/1989 | Japan . | |
| 0129658 | 5/1990 | Japan . | |

*Primary Examiner*—A. T. Grimley
*Assistant Examiner*—Robert Beatty
*Attorney, Agent, or Firm*—H. Fleischer; J. E. Beck; R. Zibelli

[57] ABSTRACT

An adaptive setup for a printing machine that stores time and date data for each usage. A pattern of the stored information is determined and processed in conjunction with operator entered restrictions in order to specify machine operating conditions for successive days and times.

22 Claims, 4 Drawing Sheets

PRINTING MACHINE ADAPTIVE SETUP

This invention relates generally to machine usage patterns, and more particularly concerns a printing machine setup that stores usage times and settings for formulating a pattern and determining future machine control settings.

Printing machines are subject to certain specific use patterns, often periodic or quasiperiodic. For example, a desired start of a day for using a machine may vary according to the day of the week. Unless an operator uses a programmable timer, either the first operator of the day faces a warmup delay or the fuser will waste energy by being preheated every day for the time specified for the day with the earliest use. Customers want to avoid such waste and desire that their machines be ready for use when the first operator arrives in the morning.

The following disclosures may be relevant to various aspects of the present invention:

U.S. Pat. No. 3,997,873—Patentee: Thornton—Issued: Dec. 14, 1976

U.S. Pat. No. 4,615,609—Patentee: Honma—Issued: Oct. 7, 1986

U.S. Pat. No. 4,701,044—Patentee: Horiuchi et al.—Issued: Oct. 20, 1987

U.S. Pat. No. 4,482,604—Patentee: Kato et al.—Issued: Nov. 21, 1989

The relevant portions of the foregoing disclosures may be briefly summarized as follows:

U.S. Pat. No. 3,997,873 discloses an apparatus that uses an operator identification system for controlling access to a plurality of photocopiers and recording each operator's usage level. The apparatus includes the use of a clock and calendar that may record the time and date of use.

U.S. Pat. No. 4,615,609 discloses an image forming apparatus including a control unit for controlling turn on or turn off of a power supply in accordance with a time preset by a setting key. The control unit may include a clock controller which clocks time and carries out various power supply controls to the apparatus such as providing the key operator with a warning of an approaching time out and an opportunity to cancel and functions such as setting the time period to auto clear the copy count.

U.S. Pat. No. 4,701,044 discloses an image recording system having a mode selection button that may supply the image produced with additional information or the like which includes: a date recording mode; a number recording mode; and a non-recording mode. The system can display a display content of a display module in the date recording mode.

U.S. Pat. No. 4,882,604 discloses an electronic machine with a device for inputting desired time information. A control system is provided in the machine so as to stop or start an operation of the machine when the current time information agrees with the desired time information.

In accordance with one aspect of the present invention, there is provided an electrophotographic printing machine, comprising means for storing at least time and date data of each printing machine usage. Means, in communication with the storing means, calculate a pattern of usage as a function of the data from the storing means. Means, in communication with the calculating means, are provided for setting the printing machine in response to the pattern of usage from the calculating means to define an adaptive mode of operation.

Pursuant to another aspect of the present invention, there is provided a method of operating an electrophotographic printing machine comprising the steps of storing at least time and date data of each printing machine usage. A pattern of usage is calculated as a function of the stored data. The printing machine is set in response to the calculated pattern of usage to define an adaptive mode of operation.

Other features of the present invention will become apparent as the following description proceeds and upon reference to the drawings.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
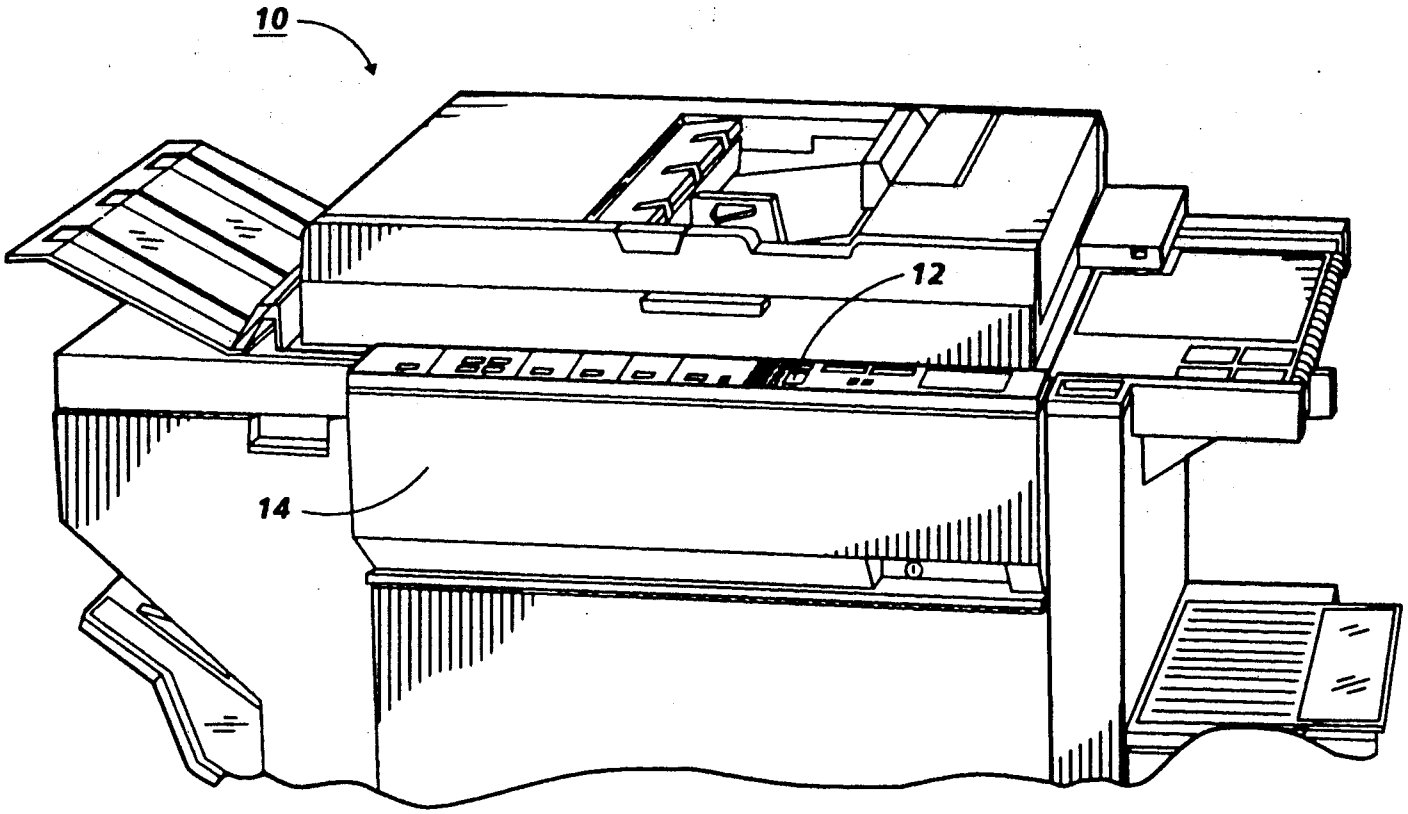
FIG. 1 is a schematic isometric view depicting a printing machine incorporating the adaptive machine setup of the present invention.

FIG. 1 depicts an electrophotographic printing machine 10 incorporating the adaptive machine setup of the present invention. It will become evident from the following discussion that this adaptive machine setup is equally well suited for use in a wide variety of printing machines and is not necessarily limited in its application to the particular printing machine shown herein. The type and style of machine are unimportant. The only necessary features are the operator interface 12, which need not be physically located on the machine, and the processing system 14.

Figure 2:
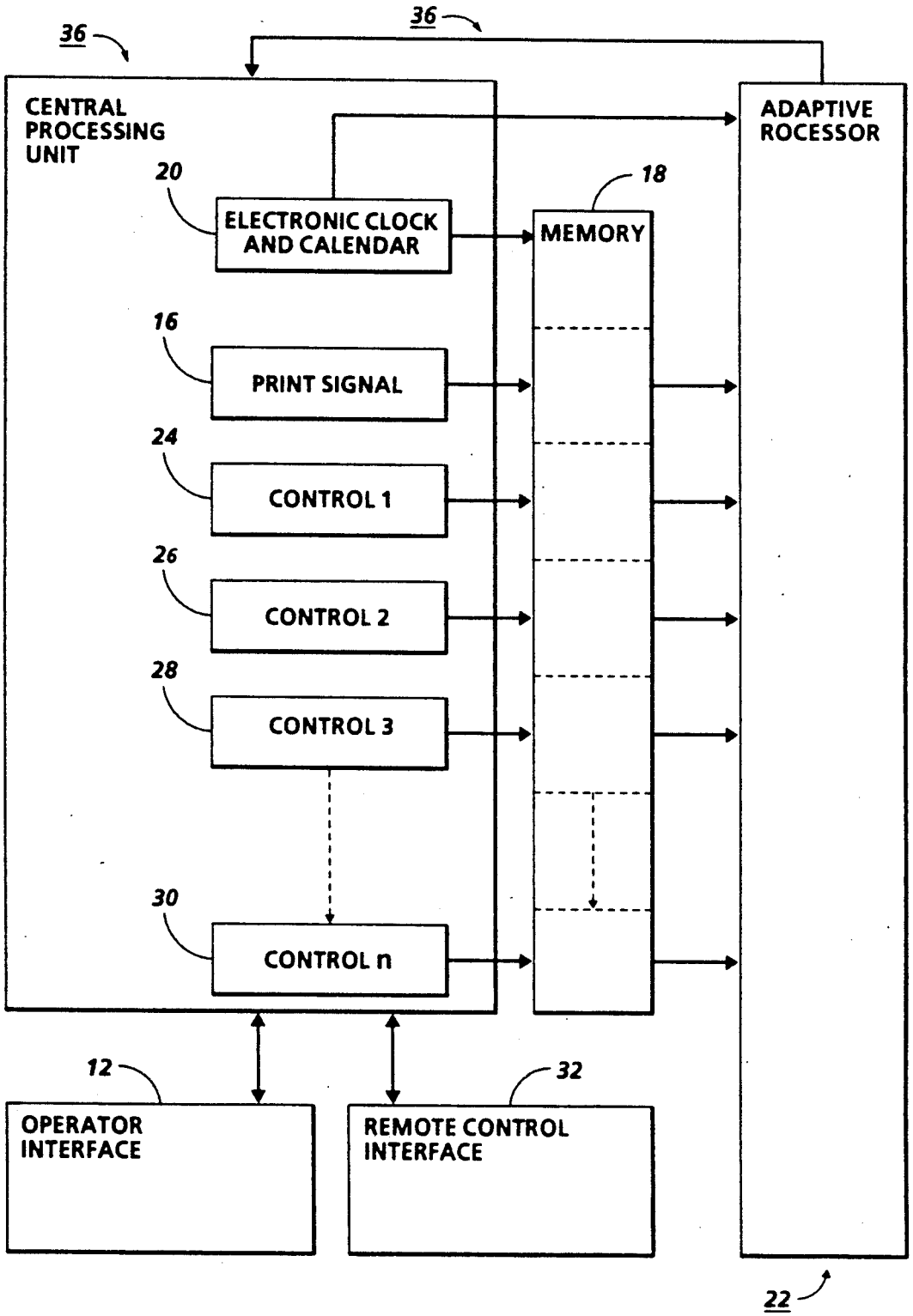
FIG. 2 is a block diagram of an adaptive machine setup in accordance with an embodiment of the present invention.

FIG. 2 depicts the present invention in greater detail. The print signal 16 serves to indicate when a usage is occurring and the memory 18 stores the desired information. The print signal is triggered by any method the operator uses to obtain a print such as, for example, pressing a print button on the operator interface 12 of the printing machine or requesting a printout through a remote interface 32. The processing system 14 also includes an electronic clock and calendar 20 for generating time and date information for the memory 18 when a the print signal 16 indicates a machine usage. Other features of the machine's setting may also generate information for the memory of the processing system 14 in response to the print signal 16. The adaptive processor 22 reads the memory, calculates a pattern, and provides adaptive machine control setting information for a central processing unit (CPU) 36 that contains controls 24, 26, 28, and 30 that can set features of the printing machine. The controls in FIG. 2 are simply representative blocks; any number and type of printing machine features can be controlled, as discussed hereinafter.

Figure 3A:
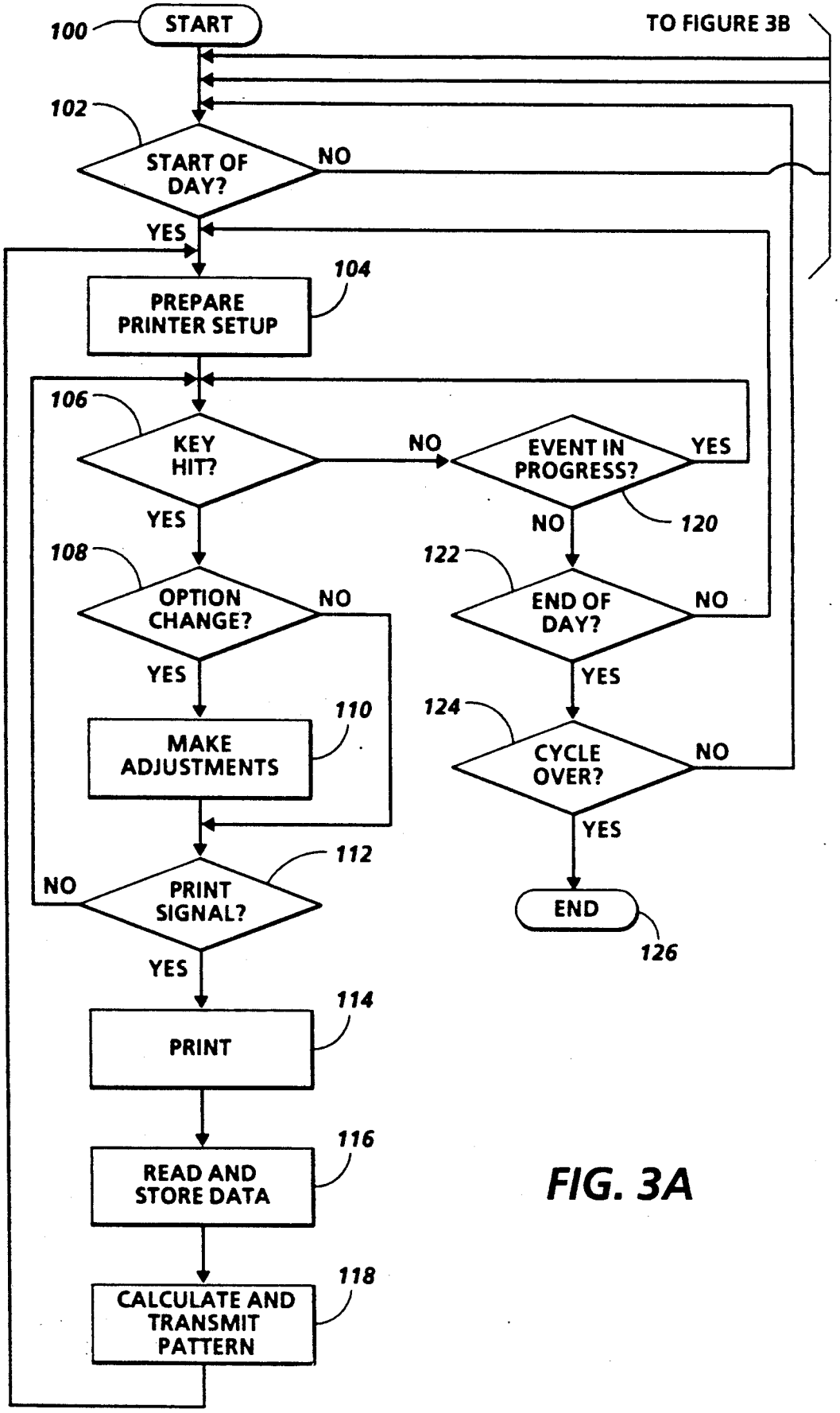
FIGS. 3A and 3B are a flow chart illustrating the operational steps of a preferred embodiment of the present invention.
Figure 3B:
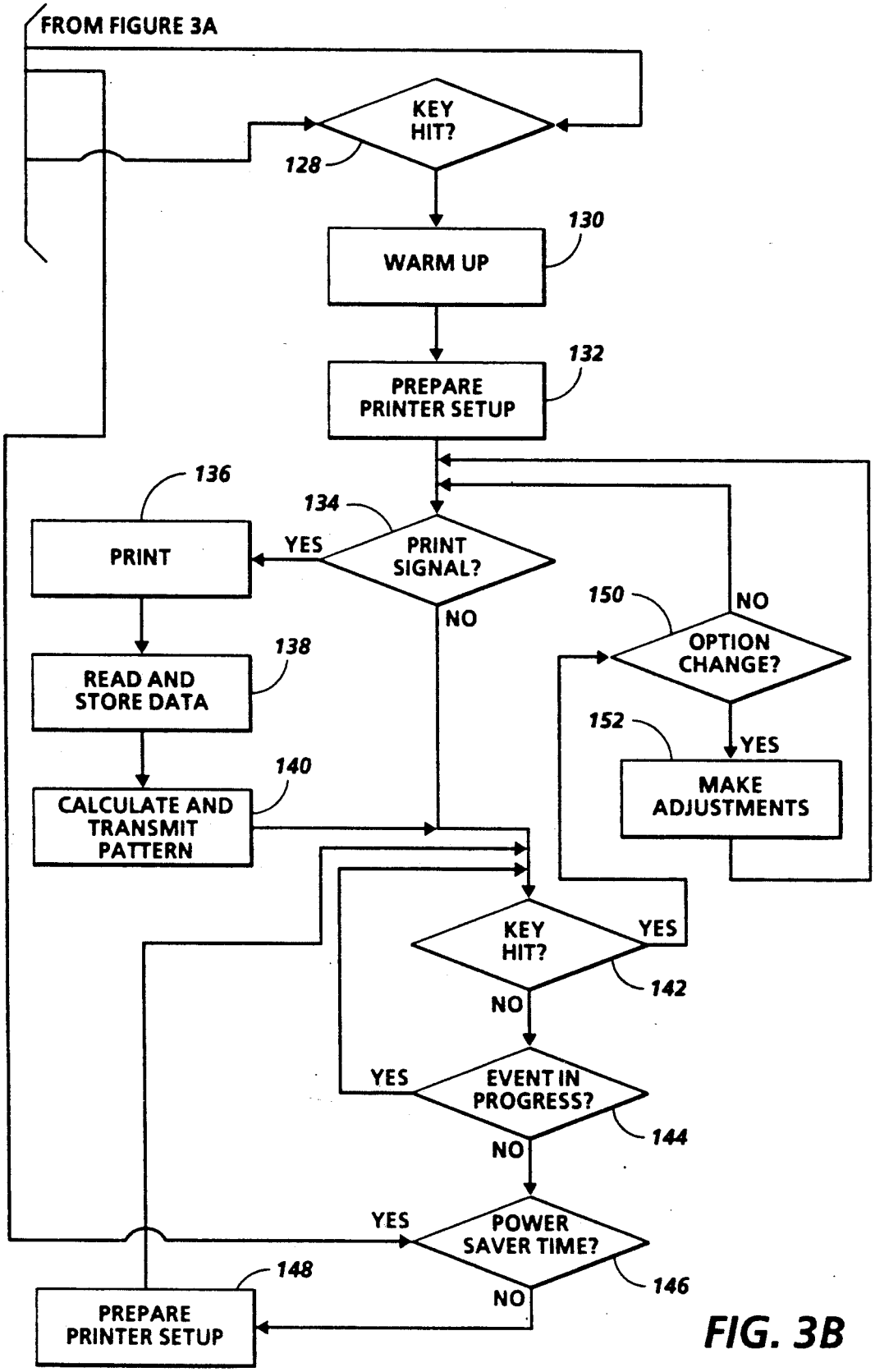

FIG. 3 is a flow chart that illustrates some of the preferred operating steps of the present invention. The start indicator (operation 100) represents the enablement of the adaptive machine setup. An adjusted setup is especially useful with respect to the "start of the day," the time of the day than an operator begins using the machine. Because leaving printing machines in the "ready to print" mode uses energy, printing machines are often turned off or placed in a power saver mode when not in use. When an operator desires to print from a machine that is off or in the power saver mode, the operator will then have to wait for the machine's fuser to warm up. Evaluating a pattern and anticipating the desired start of the day time reduces both energy waste and warm up delay. Because many different operators may use the same machine, the preferred embodiment calculates the start as the time when the usage frequency exceeds a preset threshold. For example, the processor could be designed to find that the start of the day occurs when the machine begins being used every five minutes on the average. The benefit to such a frequency analysis is that an isolated earlier than normal use of the machine will not become part of the pattern and distort the analysis. When the current time is equal to or past the setup's anticipated start of the day, then the start of the day query (operation 102) will become positive.

A similarly appropriate application of an adaptive setup is an end of the day determination. The "end of the day" refers to the time of day that the machine stops being used, and, like the start of the day, a preferred embodiment determines the end of the day by evaluating usage frequencies. The specific embodiment depends on the machine's environment. An available energy saving feature of machines automatically sets the machine in a power saver mode after it has not been used for a specific period of time and is represented in FIG. 3 by the power saver time query (operation 146). In machines without this feature, an end of the day determination prevents the possibility that the machine will be on all night if no one turns it off. In machines with the automatic power saver feature, several methods of implementing an adaptive end of the day setup are available. For example, the adaptive setup could work in conjunction with the automatic power saver by having the automatic power saver place the machine in power saver mode when not in use during the day and having the end of day time still apply if the machine is brought into the ready to print mode before the determined end of day. Alternatively, the setup may be designed to override the automatic power saver during the period of the day that the processor determines the machine is expected to be in use and to implement the automatic power saver option only during other periods of the day. The preferred embodiment includes such an override because of the advantage that the machine would always be ready for immediate use when an operator approaches it during the time period between the adaptive processor determined start of the day and end of the day. Another possible modification of the end of the day aspect would be to have a predetermined end of the day time but to delay it for some period if a threshold frequency of use is still being detected at that predetermined time. The cycle over query (operation 124) and end indication (operation 126) apply only when the adaptive setup system is being disabled.

The start and end of the day implementation can either control the power supply or the power saver mode, depending on the operator's preference. With control of the power supply, the entire machine is turned on and/or off, whereas control of the power saver mode does not involve a total absence of power. Larger machines are more likely to use the power saver mode, and the clock will continually send information to the adaptive processor 22. Smaller machines are more likely to be turned on and off by a secretary. These smaller machines can include a backup battery so that the clock is still running and accurate when the machine is turned on. Such a backup battery can also be used to power the adaptive processor to send a signal for turning the machine on at a certain time as disclosed in U.S. Pat. No. 4,882,604 to Kato et al.

The flowchart is only an example of possible operations; the operations and their order may vary. Additionally, it is not necessary that a system have both a start of day and an end of day function; the functions could work separately. For example, if a customer were more concerned with operator delay, a start of the day feature to ensure the machine is always ready for the first user might be sufficient to meet the office needs, and if a customer were more conscious of waste, an end of the day feature would be particularly desirable.

Additionally, other features of the printing machine setting may be adapted. The available control functions 24, 26, 28, and 30 of the features would depend on the type of machine and its features. Because features differ according to machine, adaptive processors would also differ according to machine. The manufacturing of processors for the different machines could be streamlined by using a unit or module approach. Each base processor could be capable of performing all the functions, but the hardware or software of each individual unit could be designed so that only the applicable control functions would operate. For example, one feature that would probably only apply to copiers is lens magnification and one that would apply to computer printers is font selection. Many features could apply to either, depending on the machine design. Some examples of such features are RIS/ROS magnification, toner density, two sided prints, paper tray, collation, staples, number of copies, color, and highlight color.

In the preferred embodiment, the operator chooses the level of adaptation through the operator interface 12. The operator interface can be any type that allows an operator to control the machine activity. For example, various forms include knobs or push buttons on the machine, remote control interfaces 32, and commands keyed in at a computer terminal. The interface is structured to allow the user to make the decisions discussed below.

First, the operator has the decision (operation not shown in FIG. 3) of whether the machine will be adaptive and, if so, which aspects of the machine will be adaptive. These choices can be implemented either at the factory or preferably through a programming process that provides the operator with the opportunity to change the options when the machine is in the office. One simple method of allowing this is to have two modes for the operator interface 12, a key mode and a technical mode. For printing use, the machine would be in the normal, key mode. For programming, an operator could get access to the technical mode with a key or an identification number and set the internal options with the same keyboard. For the features that the operator does not select to be adaptive, the operator also may have the option of using a standard setting of either factory determined defaults or specific operator programmed defaults. The nonadaptive features would then return to the standard setting when a specified time has lapsed after usage, as illustrated by the event in progress queries (operations 120 and 144). The event in progress query can be a simple timer that keeps track of the time of the last key hit and becomes negative when a certain amount of time passes without further operator interaction.

In a preferred embodiment, the operator can also use the operator interface to indicate a holiday (operation not shown in FIG. 3) when the printing machine should remain in the power off or power saver mode unless an operator tries to print on that day. To avoid distortion of the pattern, actual data for such a holiday is not used; instead the system uses data obtained for the same day of a previous week.

When an operator uses the machine to print a document, the machine will be preset and ready to print in an anticipated use mode that includes the adapted features and the default features. With a copier, the operator could view the setup in the knob positions, key positions, and digital display of the machine. With a remote interface, the operator could view the same information on a monitor. The operator can change any of these features by pressing the appropriate button or key. The CPU will detect when a key has been hit (operation 106) and make adjustments (operation 110) for any changes the operator has indicated (operation 108). "Key hit" detection includes detection of any operator interaction with the interface 12 or processing system 14.

The printing machine prints (operation 114) in response to a print signal query (operation 112). The memory 18 then reads and stores (operation 116) data about the setting, time, and date of each use. The amount and type of information about the time and date that is stored depends on the programming algorithm and the size of the memory. In large memories, information about the time, day of the week, month, and day of the month could be stored. The process may be such that either all features or only features the operator has specified as being subject to the adaptive setup are monitored. In a preferred embodiment, the memory is programmed to read and store or not to read or store when the feature control functions are selected or removed.

A processing system evaluates the data and controls future settings of features. This system can consist of either one processor or multiple processors. The example system of FIG. 2 involves two, a central processing unit (CPU) 36 and an adaptive processor 22. The processor can be designed to check the memory patterns (operation 118) either at the end of each week or day or after each use, depending on the features controlled and the algorithms used. The CPU will check and, if applicable, reset the controlled features after the conclusion of each use when it prepares the printer setup (operation 104). Additionally, the adaptive processor 22 can be designed to continually get time and date information from the clock 20 and to send adjustment instructions to the CPU to carry out at the time or, if a print job is currently in progress, after the conclusion of the current print job.

Setting up the controlled features involves adjusting any pertinent knobs, keys, and digital displays as well as making any physical adjustments necessary for the particular feature to be controlled. Each signal will respond to the control signal just like as if the button or key was manually selected. For example, in a photocopier using a lens for magnification, the lens would be physically moved for the purpose of adjusting the focus length in response to an anticipated desired magnification. Causing the print to be darker or lighter generally involves adjusting the electrical potentials on the developement roll. The choice of two-sided instead of one-sided copies involves altering the sequence in the paper feeding to place the paper in a special tray after side one has been printed and refeeding it through for printing on side two. Likewise, paper tray selection and collation options require changes in the paper feeding path. The staple option involves adjusting the paper path so as not to place paper directly in the output tray, but to first place it in a special staple tray. The number of copies indicator simply controls the number of times the machine will print the image. Colored text and highlight color options can be implemented in various ways including separate passes with separate filters and digital processing. Each of these features is placed in the ready to print mode in the same way as it would be if the operator directly selected it. The difference is that the pattern is used to anticipate what the operator will select for a given use and to save the operator the time of adjusting knobs and keys and of waiting for internal machine adjustments.

Many different algorithms exist for pattern recognition, and the appropriate technique may depend on the particular aspect of the machine that is being controlled and on the amount of available memory. Start and stop times commonly depend on the day of the week and/or the time of the month. Thus, the processor could evaluate a certain number of weeks, and observe the time of day that operations begin and end on the relevant day of each of those weeks. The data may be evaluated with simple averaging of the usage times. For example, in a start of day calculation this could involve taking the average start of day for the last three Tuesdays, converting the minutes into decimals representing portions of an hour, adding the three times together, and dividing by three. Weighted averaging is an alternative that involves placing heavier weight on the more recently collected data. For example, the time decimal of the most recent Tuesday might be multiplied by three and that of the second most recent by two. Then these numbers could be added to the third most recent decimal time and divided by six (3+2+1). Another possible calculation may be of the earliest start time or latest end time within the period. This would be a simple calculation that compares the first Tuesday with the second and discards whichever start of day time is later. Then that value would be compared with the third and one discarded, and so on. These are simply examples of potential patterns; any method of evaluating past events to predict future ones would work. If larger amounts of memory are available, data relating to the day or time of the month might also be helpful. Additionally, such data could be evaluated in conjunction with the day of the week data.

Features settings may also depend on the time, the day of the month, the day of the week, or a combination of these and thus could be evaluated with algorithms of a similar nature as those used in start and end times. For example, the magnification control pattern may show that every Monday afternoon, at 1 PM there is an extended copy count at 78% size (computer printouts for the past week are copied). Alternatively, feature settings can be programmed to depend on a pattern relating to the most common setting of a feature within the a last specified number of usages or within a most recent specified time frame. For example, the processor could look to the last eleven uses and reset to the 14" paper tray as long as six or more of those required such paper. Other patterns relating to the last number or time frame, including, for example, the above-discussed averaging and weighted averaging, are also appropriate.

The present invention can determine the setup and reset values for the coming day and/or the time of day. The start of the day and the end of the day determinations are generally best suited for determination a day or week in advance. The time for determining other features would depend on the algorithm. When the determination is based on the last specified number of usages or minutes, then it would occur after each specific usage. The processor can evaluate the new and predetermined patterns after each use and prepare the setup for the next use (operations 118 and 104). When the determination is based on typical usage for a time or a day or a combination of the two, the pattern can be determined in advance. The adaptive processor 22 can be designed to continually monitor time and date information from the clock 20 and to provide adjustment instructions to the CPU.

The machine may be used in between the end of the day and the start of the day time periods as usual, as illustrated by operations 128 through 152. It just will not be warmed up when the initial user arrives. The user could hit a warmup key, a key requesting a certain option, the print key, or any other method for triggering a positive response to the key hit query (operation 128) and begin the machine warmup (operation 130). The machine is then prepared for printing (operation 132) as the CPU sets the default options and takes into account any operator command indicated by the key hit. Additionally, if any statistically significant patterns have been calculated by the processing unit for the below discussed features for that time period, the CPU may include them in the setting. Any additional key hits are detected (operation 142) and option changes to features (operation 150) are adjusted (operation 152) before printing in response to a detected print signal (operation 135). After printing the memory 18 reads and stores data (operation 138), and the adaptive processor 22 can be programmed to calculate a pattern (operation 140) at that time if desired. After a certain period of time without use, the event in progress query (operation 144) will go negative, and the particular last operator's setting will be reset to the default (operation 148) and any control function that the adaptive processor 22 may have calculated. If no automatic power saver exists and the operator does not turn the power off or on saver mode, then the machine will remain in ready to print mode. If an automatic power saver applies, then the machine would remain on for that specific period of time before being set in the power saver mode (operation 146). If the machine goes into the power saver mode, it remains in power the saver mode until the start of the day time is reached or a key is hit.

In recapitulation, it is clear that the adaptive machine setup of the present invention stores a printing machine setting, time, and date of usage. The pattern of usage is continually evaluated and quantified. The invention then uses the pattern along with current operator commands to determine the setup for the coming day and/or next print job.

It is, therefore, apparent that there has been provided in accordance with the present invention, an adaptive machine setup that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrophotographic printing machine, comprising:

means for storing at least time and date data of each printing machine usage;

means, in communication with said storing means, for calculating a pattern of usage as a function of the data from said storing means;

means, in communication with said calculating means, for setting the printing machine in response to the pattern of usage from said calculating means to define an adaptive mode of operation; and operator selectable means for operating the printing machine in the adaptive mode or a non-adaptive mode with the choice of mode being operator selectable.

2. A printing machine according to claim 1, wherein said printing machine further comprises operator selectable means for indicating specific times when the printing machine is partially or completely de-energized.

3. A printing machine according to claim 1, wherein said calculating means calculates the pattern of machine usage for a selected day of a selected period of usage.

4. A printing machine according to claim 3, wherein said calculating means computes an average usage frequency for the selected day and compares the calculated average usage frequency with a predetermined threshold.

5. A printing machine according to claim 3, wherein said calculating means calculates an average start and an average end of day for the selected day.

6. A printing machine according to claim 3, wherein said calculating means calculates a weighted average start and a weighted average end of day for the selected day.

7. A printing machine according to claim 3, wherein said calculating means calculates a lower bound of the start of day and an upper bound of the end of day for the selected day.

8. A printing machine according to claim 1, wherein said storing means stores at least a portion of the printing machine settings for each usage.

9. A printing machine according to claim 8, wherein said printing machine further comprises means for selecting at least one setting, in the adaptive mode of operation, for resetting to the non-adaptive mode of operation.

10. A printing machine according to claim 8, wherein said calculating means calculates a control function from the usage pattern corresponding to a specified number of printing machine operations or a predetermined length of time.

11. A printing machine according to claim 8, wherein said calculating means calculates a control function from the usage pattern corresponding to a predetermined length of time.

12. A method of operating an electrophotographic printing machine comprising the steps of:

storing at least time and data of each printing machine usage;

calculating a pattern of usage as a function of the stored data;

setting the printing machine in response to the calculated pattern of usage to define an adaptive mode of operation; and operating the printing machine in the adaptive mode or in the non-adaptive mode with the choice of mode being operator selectable.

13. A method according to claim 12, further comprising the step of indicating specific times when the printing machine is partially or completely de-energized.

14. A method according to claim 12, wherein said step of calculating comprises calculating the pattern of machine usage for a selected day of a selected period of usage.

15. A method according to claim 14, wherein said step of calculating, comprises the steps of:

computing an average usage frequency for the selected day; and comparing the calculated average usage frequency with a predetermined threshold.

16. A method according to claim 14, wherein said step of calculating comprises calculating an average start and an average end of day for the selected day.

17. A method according to claim 14, wherein said step of calculating calculates a weighted average start and a weighted average end of day for the selected day.

18. A method according to claim 14, wherein said step of calculating calculates a lower bound of the start of day and an upper bound of the end of day for the selected day.

19. A method according to claim 16, wherein said step of storing stores at least a portion of the printing machine settings for each usage.

20. A method according to claim 19, wherein further comprises selecting at least one setting, in the adaptive mode of operation, for resetting to the operator selectable mode of operation.

21. A method according to claim 19, wherein said step of calculating calculates a control function from the usage pattern corresponding to a specified number of printing machine operations.

22. A method according to claim 19, wherein said step of calculating calculates a control function from the usage pattern corresponding to a predetermined length of time.

* * * * *